United States Patent [19]

Hoffmann et al.

[11] 4,421,552

[45] Dec. 20, 1983

[54] DEAD ROAST-OXIDE FLASH REDUCTION PROCESS FOR COPPER CONCENTRATES

[75] Inventors: James E. Hoffmann, South Plainfield, N.J.; Kohur N. Subramanian, Houston, Tex.

[73] Assignee: Exxon Research and Engineering Co., Florham Park, N.J.

[21] Appl. No.: 369,074

[22] Filed: Apr. 16, 1982

[51] Int. Cl.[3] ..... C22B 15/00

[52] U.S. Cl. ..... 75/9; 75/26; 75/74; 75/92

[58] Field of Search ..... 75/9, 26, 72, 73, 74, 75/92

[56] References Cited

U.S. PATENT DOCUMENTS

| | | | |
|---|---|---|---|
| 3,589,892 | 6/1971 | Peterson | 75/72 |
| 3,799,764 | 3/1974 | Opie et al. | 75/72 |
| 3,857,701 | 12/1974 | Hunter et al. | 75/74 |
| 4,006,010 | 2/1977 | Rajcevic et al. | 75/74 |
| 4,073,645 | 2/1978 | Fritsch | 75/74 |
| 4,113,470 | 9/1978 | Aaltonen et al. | 75/26 |

FOREIGN PATENT DOCUMENTS

| | | | |
|---|---|---|---|
| 1040435 | 10/1978 | Canada | 75/74 |

*Primary Examiner*—M. J. Andrews
*Attorney, Agent, or Firm*—Joseph J. Dvorak

[57] ABSTRACT

The present invention contemplates providing a finely divided copper calcine and thereafter subjecting the calcine to reduction flash smelting. Indeed, significant processing advantages are achieved by dead roasting a finely divided copper concentrate, especially in a fluid bed reduction zone, and thereafter subjecting the resulting calcine to reduction flash smelting. Gases from the dead roaster and the flash smelter are combined for $SO_2$ recovery in an acid plant.

14 Claims, 1 Drawing Figure

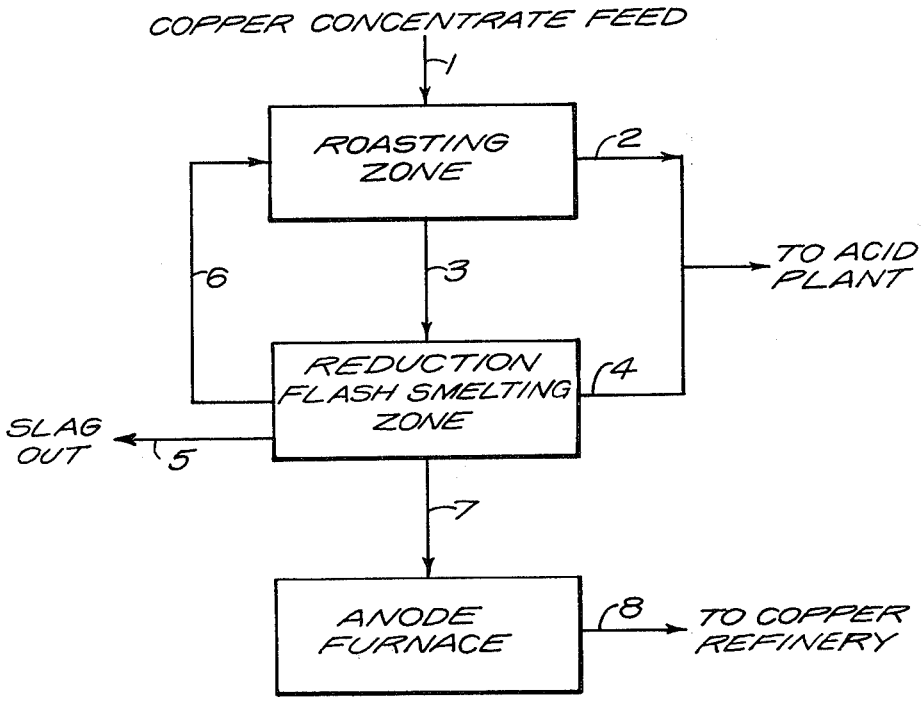
COPPER CONCENTRATE FEED
1
ROASTING ZONE
2
TO ACID PLANT
6
3
REDUCTION FLASH SMELTING ZONE
4
SLAG OUT
5
7
ANODE FURNACE
8
TO COPPER REFINERY

DEAD ROAST-OXIDE FLASH REDUCTION PROCESS FOR COPPER CONCENTRATES

FIELD OF THE INVENTION

This invention relates to the recovery of copper from copper and/or copper-iron sulfide concentrates.

BACKGROUND OF THE INVENTION

Conventional processes for recovering copper from copper and/or copper-iron sulfide concentrates involve melting them along with slag-forming ingredients in a reverberatory or flash smelting furnace to produce a copper-iron sulfide matte. This matte is then blown with air, the so-called converting operation, to produce "blister" copper which is subsequently purified by fire refining and then cast into anodes for ultimate electrolytic refining of the copper.

A significant disadvantage in this conventional copper recovery process is that sulfur is emitted as sulfur dioxide at a number of different points in the process. A major portion of the sulfur emitted during reverberatory smelting is at sufficiently low levels of concentration that it is not generally practical to recover the emitted sulfur dioxide for manufacturing by-products such as sulfuric acid, liquid $SO_2$ or elemental sulfur. This sulfur dioxide is generally discharged into the surrounding atmosphere and hence is wasted. Moreover, the emission of this sulfur dioxide to the atmosphere contributes to deteriorating air quality. Additionally, conventional copper smelting requires that molten matte and slag be transferred by ladle between the converters and the primary smelting unit (e.g., the reverberatory or flash smelting unit). During these transfers, the molten matte and slag phases may fume copiously resulting in the emission of sulfur dioxide into the workplace with all the environmental problems associated therewith. Ventilation and gas cleaning costs associated with ensuring an adequate protection of both the workplace and the environment represent a very substantial cost at present day smelters.

In recognition of the continuing concern to protect the environment and to improve process economics, a number of methods for smelting copper sulfide ores have been proposed in recent years. In this regard, reference is made to U.S. Pat. No. 3,589,892; U.S. Pat. No. 3,799,764; U.S. Pat. No. 2,857,701; and U.S. Pat. No. 4,006,010, as representative of alternate processes directed toward overcoming some of the disadvantages associated with conventional copper sulfide smelting. Notwithstanding the advances which have been made, these processes have limitations and/or disadvantages which are readily apparent to those skilled in the art.

In the process of U.S. Pat. No. 4,006,010, for example, a specifically designed smelting furnace is required, thereby increasing the mechanical complexity for the process which simultaneously decreases the process flexibility. Additionally, the step of preparing a charge for the furnace smelting operation is required, thereby adding to capital equipment needs and processing steps.

In U.S. Pat. No. 3,857,701, reliance is placed upon electric furnace smelting, which again decreases the process flexibility, increases the mechanical complexity of this process, and greatly increases the cost in terms of energy required.

For these and other reasons, there still remains a need for a new and an improved process for treating copper concentrates by pyrometallurgical processes to recover the copper therefrom.

SUMMARY OF THE INVENTION

In its simplest sense, the present invention contemplates recovering copper metal from finely divided copper calcine by reduction flash smelting of the calcine using oxygen-containing gas along with a reductant such as coke and thereafter removing the reduced copper from the reduction flash smelting zone for further refining.

In another embodiment of the present invention, a copper concentrate is dead roasted and the copper calcine produced by roasting is then subjected to reduction flash smelting.

Besides reducing energy requirements, decreasing environmental burdens and diminishing gas handling complexity, the process of this invention circumvents the classical smelting problem of requiring an oxidizing environment to burn off sulfur and oxidize iron while simultaneoulsy requiring a reducing environment to minimize copper loss to the smelting slags by providing for the oxidation of all iron and the removal of all sulfur present in the copper concentrate in a single step, preferably in a fluid bed roasting step, followed by reduction of all copper values from the roasted product by reduction flash smelting of the dead roasted calcine, using oxygen along with coke, coal or other reductants. Subsequently, recovered copper is further processed by conventional fire refining and anode casting for ultimate electrolytic refining.

A better appreciation of this invention with all of its ramifications will be apparent from the following detailed description when read in conjunction with the accompanying drawing.

DETAILED DESCRIPTION OF THE DRAWING

The sole FIGURE is a flow sheet depicting the preferred embodiment for carrying out the invention.

DETAILED DESCRIPTION OF THE INVENTION

Referring now to the FIGURE, a copper-iron sulfide concentrate is introduced via line 1 into a roasting zone, where it is roasted under conditions sufficient to essentially remove all of the sulfur in the roaster off-gas via line 2, as well as promote elimination of other volatile impurities, such as bismuth, selenium, arsenic, and antimony, typically present in the copper-iron sulfide concentrates.

In the practice of the present invention, the preferred method of roasting is fluid bed roasting which can accept, as feed, wet as well as dry concentrates. Hence, the ore concentrate can be fed via line 1 directly to the dead roasting zone, thereby eliminating the need for drying the ore concentrate and eliminating the need for providing extra facilities for such drying of the ore concentrate, as well as the substantial fuel requirements of the drying operation. This, of course, is in marked contrast to conventional flash smelting in which the copper concentrate must be dried to less than 1% moisture. Thus, a copper-iron sulfide ore concentrate containing, for example, 15% to 40% copper, and preferably in the range of 20% to 33% copper, is fed to a fluid bed dead roasting zone, where it is fluidized by ascending oxidizing gas, such as air, and is there oxidized at temperatures in the range of from about 850° C. to about 950° C. The dead roasting of the ore concentrate is conducted until the sulfur content of the ore is generally below about 2%, and preferably below about 1%.

Heat recovery from the fluid bed roasters is achieved by waste heat boilers, thereby recovering substantially all of the combustion energy of the concentrates being dead roasted in the fluid bed dead roasting zone.

The calcine obtained from the roasting zone is fed for example via line 3 to the reduction flash smelting zone. Indeed, in the broadest sense, any finely divided copper calcine, e.g., a calcine having a mesh size less than about 60 mesh and preferably between about −200 to about +325 mesh (U.S. seive size) is subjected to reduction flash smelting in accordance with the present invention. It is particularly preferred, however, that the finely divided calcine be obtained by fluid bed roasting of a copper concentrate.

Returning to the description of a preferred embodiment of the subject invention, a reduction flash smelting zone preferably consists of a furnace having four flash smelting type burners, two mounted at each end of the furnace for introduction of the calcine. Pulverized coal and an oxygen-containing gas are added through the same burners. Typically the oxygen-containing gas will contain from about 50% to about 100% by volume oxygen, and preferably about 85% to about 98% oxygen. The oxygen-containing gas under pressure conveys the coal-calcine mixture through the burners into the furnace where ignition of the mixture and reduction takes place. Typically, for a furnace producing 450 MTPD of copper, the hearth area will be approximately 32 $m^2$ with a central gas uptake. The complete furnace preferably is enclosed in a welded steel shell $\frac{5}{8}$" thick with a six inch air gap between roof shell and refractories. The furnace has a sprung arch roof with water cooled copper jackets in the mid-furnace area. Furnace wells typically are of chrome magnesite brick. The furnace bottom is magnesite brick and elevated to permit removal of the blister copper by heated launder. The blister copper is delivered, for example, from the reduction flash smelting zone to the anode furnace via line 7. Under the mildly reducing conditions present in the flash smelting zone, part of the sulfur in the calcine feed will report in the flue gas (which is removed via line 4) and the balance will report with the copper (removed via line 7). Optionally, the system may be run under sufficient reducing conditions to cause all the sulfur to report with the copper as a matte layer. In this case, the matte is skimmed, cooled, crushed and recycled to the roaster via line 6.

Also, as is shown in the figure, slag is removed from the flash smelting zone via line 5. Additionally, as is shown in the figure, the off-gases removed from the roasting zone via line 2 are combined with the flash smelter off-gases removed via line 3. Under normal operating conditions employing air as the fluidizing and oxidizing medium, a concentrate containing 28% Cu, 26.5% Fe and 33.5% sulfur will produce a roaster gas containing approximately 11.5% $SO_2$. This concentration is sufficiently high to allow combination with all flash reduction smelter off-gases while still maintaining a sulfur dioxide concentration sufficiently high to insure autogeneous operation of a double contact, double absorption sulfuric acid plant. The ability to combine substantially all smelter off-gases (both from the roasting zone and from the flash reduction zone) and still achieve a $SO_2$ level which allows autogeneous acid plant operation is a distinct advantage of the process brought about by the juxtaposition of fluid bed roasting with oxygen flash reduction of the calcine.

The copper removed via line 7 can be further processed as shown in the figure by being cast into an anode and then sent via line 8 to a copper refinery.

The invention is further illustrated by reference to the following preferred embodiment.

In this embodiment, two slinger fed fluid bed roasters are employed. This eliminates the necessity of drying the feed and hence results in a significant cost-saving by eliminating the dryer.

Each roaster has a hearth area of approximately 140 $m^2$. One roaster is located at each end of the reduction furnaces to simplify the calcine transfer system and minimize heat losses.

Roasting is carried out at 877° C. using air at 1.4 atmospheres absolute to produce a calcine containing 29.9% Cu, 0.16% sulfur as sulfide and 0.32% sulfur as sulfate, for a total sulfur content in the calcine of 0.48%. Natural gas is burned in the flue at the outlet duct of the roaster to consume the excess oxygen and minimize the formation of additional sulfate.

Calcine is recovered from the waste heat boiler and from the roaster bed overfow at an average rate of about 944 metric tons per day per roaster. Approximately 75% of the calcine reports in the waste heat boiler.

The calcine is collected by drag conveyor and drops through insultated feed pipes to insulated calcine storage bins above the reduction furnace burners. It is estimated that the calcine fed to the reduction furnace burners will be about 420° C. It should be understood, however, that the calcine may be at a lower temperature in which event more fuel will be required in carrying out the subject process.

Off-gas from the roasters, containing about 11.6% $SO_2$, is cooled from 877° C. to 327° C. in a waste heat boiler to produce about 36.8 metric tons per day of steam at 48 atmospheres absolute and 260° C.

Final dust cleaning is carried out in an electrostatic precipitator and the dust, approximately 49 metric tons per day per roaster, is returned to the feed circuit.

Cleaned roaster gas is combined with the low $SO_2$ content gas from the reduction furnace and sent to the acid plant.

The calcine and flux is fed to the reduction furnace at 420° C., using four burners, two mounted at each end of the furnace. Pulverized coal and commercial oxygen, at 95% purity, are added through the same burners in amounts sufficient to support autogenous reduction of the copper oxide in the calcine and to melt the copper so produced, i.e., in amounts sufficient to reduce the copper oxide in the calcine to copper metal and to reduce the iron oxides such as hematite and magnatite present in the calcine to fayalite and to maintain a ratio of $pCO_2/pCO=30$ in the furnace atmosphere and a furnace temperature of 1227° C.

Blister copper, containing 98.9% Cu and about 1% S, continuously overflows a syphon and is conveyed by launder at the rate of 459 metric tons per day to the anode furnaces. Furnace slag analyzing about 4.9% Cu overflows a weir and is transferred to the slag cooling area by carrier. 1078 metric tons per day of slag is produced.

Residual CO in the furnace atmosphere is burned off by metering a small amount of oxygen into the furnace uptake. The flash reduction furnace waste heat boiler reduces the off-gas temperature from 1227° C. to 350°

C., thereby generating 12.4 metric tons per hour of steam at 48 atmospheres absolute and 260° C.

The furnace off-gas now containing 65.3% $CO_2$ and 1.1% $SO_2$ is cleaned in an electrostatic precipitator and combined with the higher $SO_2$ gas from the roasters. The combined stream feeds a double catalysis acid plant.

The furnace slag containing approximately 4.9% Cu is cleaned prior to discarding. A slow cooling-flotation slag cleaning step is used.

Blister copper from the furnace flows directly by heated launder to one of the two anode furnaces.

Sulfur is removed from the blister copper by injection of air using conventional practice. Poling is accomplished using reformed natural gas.

Either a conventional Walker wheel or a Hazelett continuous casting line is used for anode production.

As should be readily apparent from the foregoing description of the present invention, the following advantages are obtained:

(a) the classical smelting problem of requiring an oxidizing environment to burn off sulfur and oxidize iron while simultaneously requiring a reducing environment to minimize copper loss to the smelting slags is achieved in a practical manner;

(b) environmental burdens are decreased since $SO_2$ emitted is at sufficiently high concentrations so as to be recoverable in an acid plant;

(c) gas handling is simplified greatly, particularly since a major reduction in gas volumes handled is achieved when compared to normal smelting of copper calcines through oxygen flash reduction;

(d) energy requirements are reduced considerably;

(e) the process is particularly suited to operation in a continuous manner; and (f) fugitive emissions are virtually eliminated by elimination of the converter aisle.

What is claimed:

1. A method of obtaining blister copper from a copper calcine comprising:

providing a finely divided copper calcine having a particle size less than about 60 mesh; and charging said calcine into a reduction flash smelting zone for reduction therein, said calcine being charged into said zone with an oxygen-containing gas and a reductant, said gas and reductant being present in amounts sufficient to effect reduction of said calcine whereby blister copper is obtained.

2. The method of claim 1 wherein said copper calcine has a particle size ranging from about −200 to about +325 U.S. mesh seive size.

3. The method of claim 2 wherein said oxygen-containing gas contains from about 50% to about 100% by volume of oxygen.

4. The method of claim 2 wherein said oxygen-containing gas contains from about 85% to about 95% of oxygen.

5. The method of claim 3 including dead roasting a finely divided ore concentrate to a finely divided copper calcine.

6. A method of producing copper from an ore concentrate containing copper and iron sulfides comprising:

dead roasting said concentrate of said ore in contact with an oxygen-containing gas at temperatures sufficient to promote the conversion of the copper and iron sulfide in said ore to a calcine-containing copper oxide and iron oxide, respectively; and charging said calcine into a reduction flash smelting zone for reduction therein, said calcine being charged into said zone with a reductant and an oxygen-containing gas, said reductant and gas being charged in amounts sufficient to effect reduction and melting of the copper content of the calcine to form blister copper.

7. The method of claim 6 wherein said oxygen-containing gas contains from about 50% to about 100% oxygen by volume.

8. The method of claim 6 wherein said oxygen-containing gas contains from about 85% to about 98% oxygen.

9. The method of claim 7 wherein $SO_2$ containing gases generated during said roasting and said reduction flash smelting are combined for recovery.

10. The method of claim 9 wherein the $SO_2$ from said gases is subsequently converted to and recovered as sulfuric acid.

11. The method of claim 9 wherein said ore concentrate is finely divided into fluidizable particle sizes and said ore is fluidized by an oxygen-containing gas in dead roasting said concentrate.

12. The method of claim 11 wherein said ore concentrate is selected from wet and slurried concentrates.

13. A method for producing copper from an ore containing copper and iron sulfides comprising:

providing said ore concentrate in fluidizable particle sizes;

fluidizing and dead roasting said ore with an oxygen-containing gas at temperatures sufficient to convert the ore to a calcine-containing copper and iron oxides and to produce an effluent gas containing $SO_2$;

smelting said calcine in a reduction flash smelting zone at a temperature and with an oxygen-containing gas and an amount of reductant sufficient to form blister copper and to provide an off-gas containing $SO_2$;

combining said off-gas and said effluent gas and recovering $SO_2$ therefrom; and recovering said blister copper from said smelter.

14. The method of claim 13 wherein said fluidizing and roasting of said concentrate, said smelting of said ore and said recovery of $SO_2$ and copper is continuous.

* * * * *